US008714312B2

(12) United States Patent
Tiner et al.

(10) Patent No.: US 8,714,312 B2
(45) **Date of Patent: *May 6, 2014**

(54) ELEVATOR SAFETY RESCUE SYSTEM

(76) Inventors: James L. Tiner, Lakeway, TX (US); Todd C. Grovatt, Lakeway, TX (US)

( * ) Notice: Subject to any disclaimer, the term of this patent is extended or adjusted under 35 U.S.C. 154(b) by 438 days.

This patent is subject to a terminal disclaimer.

(21) Appl. No.: 13/099,996

(22) Filed: May 3, 2011

(65) Prior Publication Data

US 2011/0203877 A1 Aug. 25, 2011

Related U.S. Application Data

(63) Continuation-in-part of application No. 12/457,759, filed on Jun. 19, 2009, now Pat. No. 8,191,689.

(51) Int. Cl.
*B66B 1/28* (2006.01)

(52) U.S. Cl.
USPC ..... 187/285; 187/293; 187/288

(58) Field of Classification Search
USPC ..... 187/247, 275, 277, 281, 285–290, 293, 187/295–297, 391–393
See application file for complete search history.

(56) References Cited

U.S. PATENT DOCUMENTS

| | | | | |
|---|---|---|---|---|
| 3,757,701 | A | 9/1973 | Lepley et al. | |
| 3,878,916 | A | 4/1975 | White, Jr. | |
| 3,967,703 | A | 7/1976 | Martin | |
| 4,469,198 | A | 9/1984 | Crump | |
| 4,488,621 | A * | 12/1984 | Schiewe | 187/347 |
| 4,516,663 | A | 5/1985 | D'Alessio et al. | |
| 4,662,478 | A | 5/1987 | Uchino | |
| 4,807,724 | A | 2/1989 | Martin | |
| 5,558,181 | A | 9/1996 | Bundo | |
| 5,819,876 | A | 10/1998 | Chao | |
| 6,830,132 | B1 | 12/2004 | Kang et al. | |
| 7,311,179 | B1 | 12/2007 | Franklin | |
| 7,434,664 | B2 | 10/2008 | Helstrom | |
| 8,146,714 | B2 * | 4/2012 | Blasko | 187/290 |
| 8,172,042 | B2 * | 5/2012 | Wesson et al. | 187/382 |
| 8,191,689 | B2 * | 6/2012 | Tiner et al. | 187/285 |
| 8,220,590 | B2 * | 7/2012 | Chen et al. | 187/290 |
| 8,230,978 | B2 * | 7/2012 | Agirman et al. | 187/290 |
| 2007/0056806 | A1 | 3/2007 | Okamoto et al. | |
| 2007/0131488 | A1 | 6/2007 | Matsuoka | |
| 2008/0083588 | A1 | 4/2008 | Leon | |

* cited by examiner

*Primary Examiner* — Anthony Salata
(74) *Attorney, Agent, or Firm* — Richard C Litman

(57) ABSTRACT

The elevator safety rescue system is an electro-hydraulic system particularly suited for use in rack and pinion drive elevators installed with tall towers, mines, smoke stacks, and other structures having relatively large elevations or depths. The system includes a positive displacement hydraulic pump driven by the output shaft of an electric elevator drive motor. An electro-hydraulic valve is electrically powered to maintain an open condition to allow unrestricted hydraulic flow through the pump during normal operation. In the event of an elevator malfunction, electrical power is terminated to the valve, causing the valve to close and thus requiring all hydraulic fluid to pass through a restrictor. The restrictor limits the flow of hydraulic fluid through the hydraulic pump, thus limiting its rotational speed and rotational speed of the elevator drive motor to which it is attached, thereby allowing the elevator to descend or climb (with counterweight) at a safe speed.

19 Claims, 4 Drawing Sheets

ELEVATOR SAFETY RESCUE SYSTEM

CROSS REFERENCE TO RELATED PATENT APPLICATION

This application is a continuation-in-part of U.S. patent application Ser. No. 12/457,759 filed on Jun. 19, 2009 now U.S. Pat. No. 8,191,689.

BACKGROUND OF THE INVENTION

1. Field of the Invention

The present invention relates generally to elevator systems, and more particularly to an elevator safety rescue system permitting the elevator car of a rack and pinion elevator system to be lowered slowly in the event of malfunction. A counterweight system may be added to raise an elevator from the bottom of a shaft.

2. Description of the Related Art

Rack and pinion drive elevator systems are often used to power elevators installed in industrial applications, including relatively high structures, e.g., industrial elevators installed in tall towers used for broadcast communications towers, smoke stacks, bridge towers, etc., or in relatively deep excavations such as mines. Rack and pinion elevator systems are free of the height limitations particularly affecting hydraulic elevators and also affecting cable elevator systems to a lesser degree.

These rack and pinion drive elevators are of course required to have safety features analogous or equivalent to elevators using other lift and propulsion principles, i.e., cable and hydraulically powered elevators. It is of course absolutely essential that any elevator include a system that prevents the elevator from falling in the event of power failure or lift malfunction. In the cases of hydraulic and particularly cable type elevators, where loss of hydraulic pressure or cable breakage could allow an essentially free fall of the elevator cab, various braking systems have been developed and are required to be included in such installations. Rack and pinion drive elevators are also required to have an overspeed elevator safety device, but the principles are somewhat different, in that the drive system pinion gear is positively engaged with the gear rack at all times such that slowing or stopping rotation of the pinion drive motor(s) by means of a motor braking system also slows or stops movement of the elevator; such systems are inherently free of any danger of slippage. Additionally, the rack and pinion drive configuration can allow for an additional safety rescue lowering device that can allow for the safe self rescue of a stranded car.

Any time the emergency system stops the elevator due to some malfunction in the system, there exists the issue of safe rescue for the elevator and its passengers and freight to a safe landing or location. Historically, this is accomplished by actuation of a mechanism causing the electric drive motor brakes to slip, thus allowing the elevator to descend gradually. However, the heat generated from slipping brakes can be considerable, particularly in the case of relatively tall elevators. Moreover, the heating of the brakes reduces their capacity, causing a restriction of operational use to a few minutes or approximately thirty feet before overheating occurs. This may be acceptable for a short height installation. However, elevators installed in tall industrial locations or mines may have landing levels with distances between landings of many times those between landing levels on short height installations, thus preventing a safe and effective rescue using a slip brake system due to the heat buildup and resulting reduction in braking capacity in such a system.

It will also be noted that the use of slipping motor brakes to allow the elevator to descend, does nothing to lift a stranded elevator from a mine shaft or the like. In the event of an emergency or disaster in a mine, some other means must be provided to lift the elevator safely from the bottom of the shaft, in order to evacuate persons trapped at the bottom of the mine.

Thus, an elevator safety rescue system solving the aforementioned problems is desired.

SUMMARY OF THE INVENTION

The elevator safety rescue system is an electro-hydraulic system permitting the car of a rack and pinion elevator to be rescue lowered safely in the event of a malfunction of the operating system. The safety system includes a hydraulic circuit having a positive displacement hydraulic pump directly connected to and driven by the output shaft of an electric motor that is part of the primary drive system mounted atop the elevator car. The electric motor is directly connected to the pinion gear that drives the elevator up and down the vertical rack gear permanently mounted in the hoistway. The hydraulic flow through the hydraulic pump is functionally unrestricted during normal elevator operation, but is highly restricted in the event of a rescue lowering operation. This restricted hydraulic flow limits the rotational speed of the positive displacement hydraulic pump, in turn limiting the rotational speed of the drive motor and pinion gear to which the hydraulic pump is directly connected. This allows the elevator to descend at a safe speed by limiting the rotational speed of the drive system when the rescue lowering function is actuated and the electric motor brake is released.

The hydraulic flow is controlled by an electro-hydraulic valve that automatically actuates to the flow restricted condition (fail-safe state) in the event of loss of electrical power to the system, including each time the elevator stops during normal operation. For car movement during normal operation, electrical power is provided to the electro-hydraulic flow valve, maintaining that valve in the open unrestricted flow condition. To affect a rescue lowering operation simply requires the included backup electrical power (UPS, or Uninterruptible Power Supply) be applied to release the electric motor drive brakes, thus allowing gravity to cause a controlled downward elevator movement. With this system there is no slippage of the motor brakes, as in other elevator systems, as they are completely disengaged. Control of the elevator movement is accomplished by the restricted hydraulic oil flow through the hydraulic restrictor valve that is automatically set to the flow restricted position absent electrical power to the restrictor valve. The elevator safety rescue system allows for safe, full height lowering by dissipating the heat buildup resulting from the lowering operation through the hydraulic system and not the motor brakes.

It will be noted that nothing in the preceding description restricts the operation of the system only to downward movement of the elevator car. A counterweight may be added to the system, to draw the car upwardly from the bottom of a shaft or hoistway. The restricted hydraulic flow will still result in the slow, smooth lifting of the elevator car, with the flow of the fluid through the restrictor valve being in the opposite direction from that when the car is descending. The remainder of the system works identically whether the car is rising or descending, with the only difference being the addition of a counterweight heavier than the loaded elevator car and its counterweight cable.

These and other features of the present invention will become readily apparent upon further review of the following specification and drawings.

BRIEF DESCRIPTION OF THE DRAWINGS

Similar reference characters denote corresponding features consistently throughout the attached drawing.

DETAILED DESCRIPTION OF THE PREFERRED EMBODIMENTS

Figure 2:
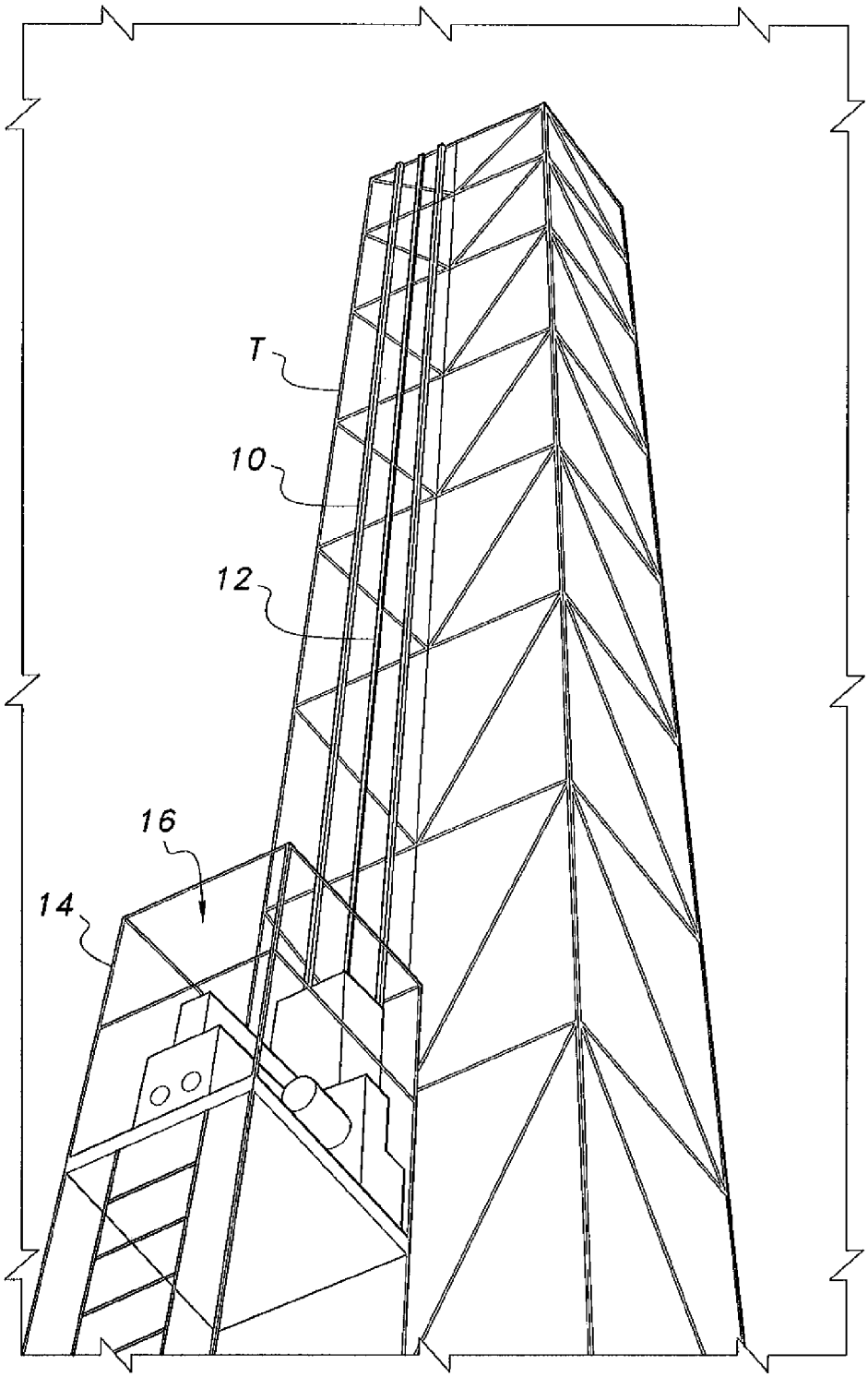
FIG. 2 is an elevation view of an exemplary elevator system incorporating the elevator safety rescue system of FIG. 1.

The elevator safety rescue system is particularly suited for relatively tall or deep elevator systems using rack and pinion drive mechanisms. An exemplary elevator guiderail installation 10 on a tower T is illustrated in FIG. 2, with the guiderail 10 extending up the tower T. The guiderail installation 10 includes a toothed elevator rack 12 extending generally vertically therealong and an elevator car 14 engaging the rack 12 and guiderail 10 for travel therealong. The components of the elevator safety rescue system 16 are installed generally atop the car 14, as shown in FIG. 2. Alternatively, the system could be adapted to elevators of any height or depth and using other principles of operation.

Figure 1:
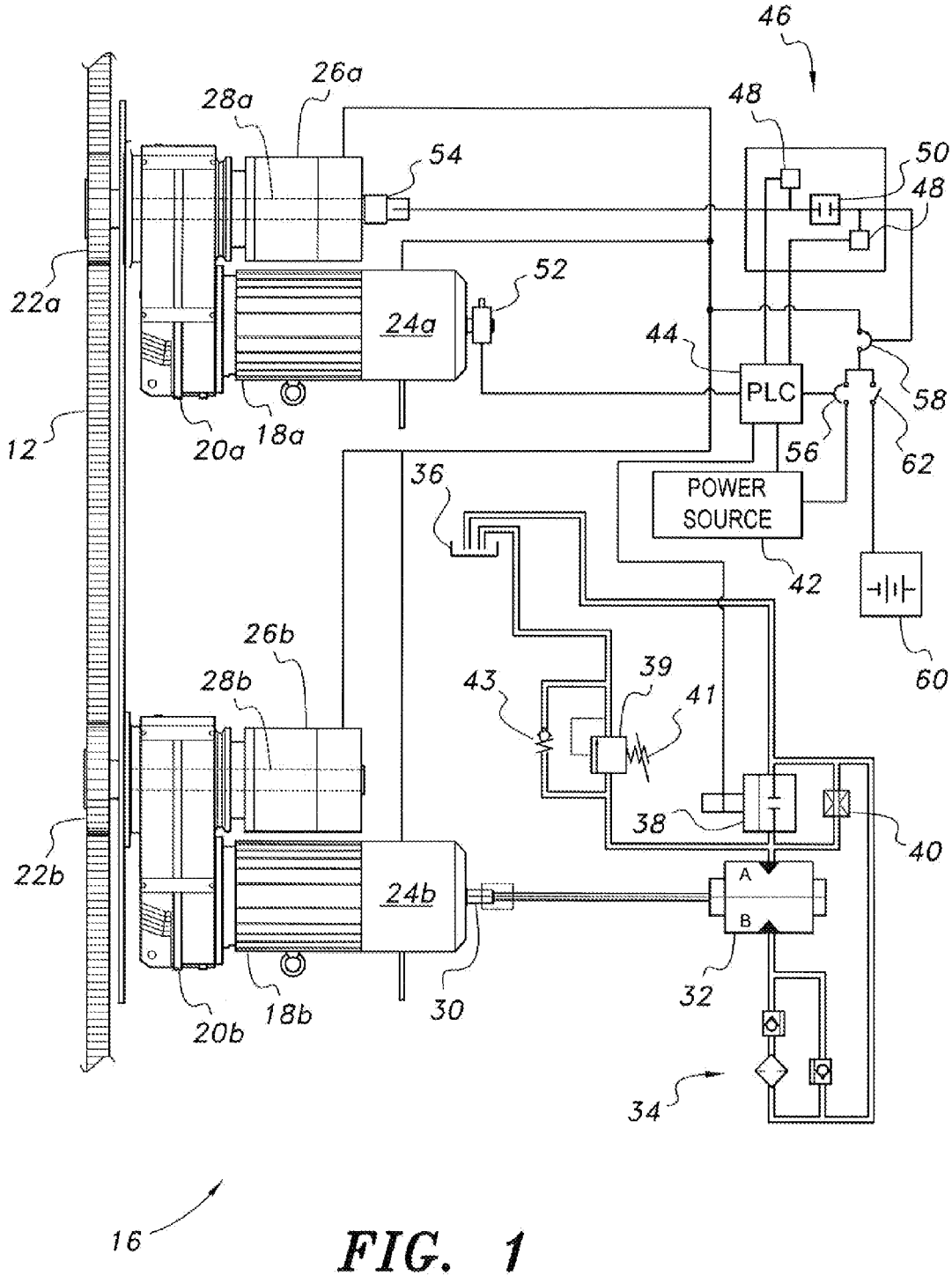
FIG. 1 is a schematic drawing of the basic mechanical, electric, and hydraulic subsystems of the elevator safety rescue system according to the present invention.

FIG. 1 provides a schematic drawing of the components of the elevator safety rescue system 16. The system 16 of FIG. 1 includes first and second electrically powered drive motors 18*a* and 18*b*, respectively. The first motor 18*a* is positioned directly above the second motor 18*b*. Each of these motors 18*a* and 18*b* is mechanically coupled to and drives a gearbox 20*a* and 20*b*, respectively. The gearboxes 20*a* and 20*b* provide the desired reduction of rotational speed and corresponding torque multiplication. Each gearbox 20*a*, 20*b* has an output shaft driving a pinion gear 22*a* and 22*b*, respectively. The two pinion gears, in turn, engage the toothed elevator rack 12 to raise and lower the elevator car 14 when power is applied to the two motors 18*a*, 18*b*.

The motor and gearbox assemblies 18*a*, 18*b*, 20*a*, and 20*b* further include multiple electromechanical brakes. Each motor 18*a*, 18*b* includes an electromechanical motor brake 24*a* and 24*b*, respectively, extending from the output shaft of the motor opposite the gearbox. In addition, an electromechanical rack and pinion safety brake 26*a* and 26*b*, respectively, extends from each rack and pinion drive shaft 28*a*, 28*b* of the gearbox 20*a* and 20*b* opposite the pinion gear extending therefrom. These brake devices 24*a*, 24*b*, 26*a*, and 26*b* are all mechanically actuated, i.e., no electrical or other energy is required for actuation. In fact, each of the brakes 24*a* through 26*b* includes a spring mechanism that urges the brakes to an engaged condition at all times. The brake application spring mechanisms are overcome by electric solenoids that hold the brake application springs in a retracted condition so long as electrical power is applied thereto. Thus, when the system 16 loses electrical power, the brakes 24*a* through 26*b* are automatically applied to stop any motion of the elevator car 14. The brakes may be released by application of electrical power from a backup or reserve source of electrical energy to allow movement of the elevator car during emergency operations, as described further below.

At least one of the two motors and its motor brake, e.g., the second motor 18*b* and motor brake 24*b*, includes an output shaft 30 extending therefrom opposite the gearbox 20*b*. A positive displacement hydraulic pump 32 is installed on the output shaft 30, and is driven by the output shaft 30. The pump 32 is installed in a hydraulic system having a conventional filter and check valve subsystem 34, reservoir 36, and other conventional hydraulic components. The safety rescue operation provided by the hydraulic system is provided by a an electro-hydraulic flow control valve 38 installed in series with the hydraulic pump 32, and a restrictor orifice 40 installed in parallel with the flow control valve 38.

The hydraulic system, which includes pump 32, flow control valve 38, and restrictor valve 40, does not stop or lock up movement of the elevator car 14 in the event of an electrical power failure. That function is left to the braking system described in part further above. Rather, the hydraulic system provides for the controlled slow vertical travel of the elevator car 14 in an emergency once the brakes have been released. The electro-hydraulic flow control valve 38 operates in a manner analogous to that of the electromechanical brakes, i.e., it allows normal movement of the elevator car 14 only when electrical power is received by the valve 38 to hold the hydraulic mechanism open. This holds the valve 38 open and allows full and unrestricted hydraulic fluid flow through the valve 38. This fluid flow is provided by the positive displacement hydraulic pump 32, which is, in turn, rotated by the output shaft 30 from one of the drive motors, e.g., the second motor 18*b*, through a common shaft with its motor brake 24*b*. Thus, so long as normal electrical power is received by the electro-hydraulic valve 38 to hold the valve open, the flow produced by the pump 32 as a result of rotation by the motor 18*b* is unrestricted during normal elevator operation.

In the event that electrical power is lost, the electro-hydraulic valve 38 automatically closes. In this situation, the alternative hydraulic flow path is through the restrictor orifice 40 in parallel with the now closed valve 38. As the hydraulic fluid flow is greatly reduced due to the restriction in the orifice 40, rotation of the positive displacement hydraulic pump 32 is impeded. As the pump 32 is directly connected to the output shaft of the motor 18*b* through its output shaft 30 extending from its motor brake 24*b*, the rotational speed of the motor 18*b* is also reduced in accordance with the restriction of the valve 40. This reduces the rotational speed of the pinion 22*b* accordingly, thereby allowing the elevator car 14 to travel at a slow and safe rate so long as the motor brakes 24*a*, 24*b* and rack and pinion shaft brakes 26*a*, 26*b* are released.

It will be seen that certain anomalies in the electrical system, e.g., a suddenly opened circuit control device or a broken wire to the electro-hydraulic flow control valve 38, will result in that valve 38 suddenly closing while electrical power is still being provided to the rest of the system. Thus, the elevator drive motors 18*a*, 18*b* will continue to rotate, driving the hydraulic pump 32, and the brakes 24*a* through 26*b* will remain in their released condition. This results in all of the hydraulic pressure developed by the pump 32 suddenly being forced through the restrictor orifice 40 as the system attempts to bypass the closed flow control valve 38. The sudden jump in hydraulic pressure can result in damage to the system.

Accordingly, an overpressure relief bypass valve 39 is provided in the hydraulic system. This valve 39 permits hydraulic flow in only one direction, viz., from the circuit between the pump 32 and flow control valve 38 to the reservoir 36, thus allowing excessive hydraulic pressure to bypass the now closed flow control valve 38 and restrictor orifice 40 and flow through the relief bypass valve 39 back to the reservoir 36. The opening pressure of the relief bypass valve 39 may be adjusted by means of the adjuster 41, e.g., to 3,000 psi for a 2,700 psi nominal operating pressure, or to other suitable operating and relief pressures. Thus, the relief bypass valve 39 remains closed during normal operation, but will open to relieve excessive hydraulic pressure in the event of a sudden overpressure event.

It will be seen that hydraulic flow travels in the opposite direction when the elevator car is traveling in the opposite direction, since the pump 32 is bi-directional. In this situation, the pump 32 is attempting to draw hydraulic fluid through the now closed flow control valve 38 and the closed, one-way overpressure relief bypass valve 39. The lack of hydraulic fluid to the pump 32 while it is in operation might lead to damage to the pump. Accordingly, a one-way check valve 43 is provided in parallel with the bypass valve 39 to allow fluid to flow from the reservoir 36 to the hydraulic circuit and pump 32.

Electrical power is normally supplied to the brakes 24*a* through 26*b* by an electrical system receiving power from a conventional electrical source 42 (e.g., an electric power grid, an industrial generator, etc.). The electrical source 42 normally supplies electrical power to the entire elevator system at all times for normal operation of the system. Electrical power is also provided to a programmable logic controller (PLC) 44, which controls many of the functions of the safety system. The controller 44 communicates with an independent safety overspeed controller 46, which includes a safety governor status monitor 48 and a safety voltage relay or regulator 50.

The PLC 44 also communicates with a motor speed and position control 52, which communicates rotationally with an output shaft from one of the drive motor and motor brake assemblies (e.g., the first drive motor 18*a* and its motor brake 24*a*). In addition, a safety speed governor or voltage generator 54 is rotationally coupled to the rack and pinion shaft extending through one of the two rack and pinion brakes, e.g., the first shaft 28*a* of the first brake 26*a*. This device communicates electrically with the safety overspeed controller 46, or more specifically, with the safety voltage relay or regulator 50 of the controller 46. As long as the PLC 44 senses normal conditions from these various components 48, 50, 52, and 54 through the controller 46, it holds a relay 56 closed to provide electrical power from the power source 42 to the dual motor brakes 24*a*, 24*b* and dual rack and pinion brakes 26*a*, 26*b*.

It will be recalled that these four electromechanical brakes 24*a* through 26*b* are held in their released configuration so long as electrical power is supplied thereto, thus allowing normal elevator operation. There are various parameters that must be met in order for electrical power to be supplied to hold the brakes in their released condition for normal elevator operation. One such parameter is provided by the speed and position control 52 disposed on the output shaft of the first motor and brake assembly 18*a* and 24*a*. This device 52 communicates electrically with the PLC 44. The PLC receives and processes the signal from the control 52 to determine if any conditions other than normal are occurring. The rotational speed of the motor 18*a* is transmitted rotationally to the speed and position controller 52, which generates a corresponding electrical signal. This signal is received by the PLC 44, which analyzes the signal to determine if there is some abnormal condition, e.g., an overspeed or unexpected speed for the given operating conditions, or even a signal loss. Any of these conditions will result in the PLC 44 opening the relay 56, thus shutting off electrical power to all of the brakes 24*a* through 26*b* to actuate the brakes and stop the elevator car.

The independent safety overspeed governor or voltage generator 54 operates somewhat differently than the speed and position control device 52. The governor or generator 54 develops a voltage output proportional to the rotational speed of the rack and pinion shaft 28*a*, which, in turn, is rotated by the pinion 22*a* as the elevator car moves up and down along its guiderail. In the event that elevator travel reaches too high a speed, the rotational velocity of the pinion gear 22*a* and safety speed governor or generator 54 will be correspondingly high. The governor or generator sends a correspondingly high voltage to the safety voltage relay or regulator 50 in the overspeed controller 46. When this occurs, the safety relay or regulator 50 will open, thus terminating electrical power to the safety relay 58 to cause it to open. As the safety relay 58 serves as a cutoff switch and is in series with the electrical power source 42 and brakes 24*a* through 26*b*, it will be seen that electrical power to the brakes will be interrupted, thus causing the brakes to activate to slow and stop the elevator car.

Once this has occurred, the rotational speed of the speed governor or generator 54 is reduced to zero, resulting in no voltage output from this device. The safety voltage relay or regulator 50 recognizes this, and resets or closes the safety relay 58 to provide electrical power to the brakes for disengagement. However, it will be seen that the anomalous condition that resulted in the opening of the cutoff switch or relay 58 is also monitored by the PLC 44, which terminates electrical power to the system to retain the brakes in their actuated condition to hold the elevator. The system still cannot move, solely due to the stoppage of rotation to the speed governor or controller 54.

Assuming that the above systems have operated as designed, the elevator car has stopped its motion at some random location along its guiderail due to the brakes being applied. The elevator safety rescue system accordingly provides means for persons in the elevator to operate the car in an emergency mode to travel to a convenient level (or to the surface) to allow persons to leave the car. This is provided by an uninterruptible power supply 60, e.g., an electrical storage battery, etc., that is isolated from the remainder of the electrical system until called upon. In the event that the safety system described above has actuated and stopped the elevator car at some random location, a person in the car may close the lowering or movement control switch 62 located within the elevator car. This switch 62 allows electrical power to flow from the backup electrical source 60 through the now closed cutoff switch or relay 58, and on to the four electromechanical brakes 24*a* through 26*b*, thereby opening the brakes 24*a* through 26*b* to allow a controlled rescue movement of the elevator car.

It will be noted that the electro-hydraulic flow control valve 38 receives its electrical power from the PLC 44 system. As the PLC 44 has shut down the electrical system due to power loss arising from some malfunction or anomalous condition in order for the lowering or movement control switch to be required, it will be seen that no electrical power is being delivered to the electro-hydraulic valve 38 under these conditions. As a result, the valve 38 will remain closed. This results in all hydraulic fluid in the safety lowering or movement system being routed through the restrictor orifice 40. As the orifice in the restrictor 40 is relatively small, hydraulic fluid flow therethrough is quite limited, thus limiting the rotational speed of the positive displacement hydraulic pump 38 accordingly. This, of course, limits the rotational speed of the motor and brake output shaft 30 to which the pump 38 is attached, thus limiting the rotation of the pinion 22*b* to restrict elevator movement to a relatively slow and safe descent or travel speed.

The lowering or movement safety switch 62 is preferably a normally open switch, requiring the operator to hold the switch closed in order to provide emergency electrical power to the brakes to hold them open. If the operator releases the safety switch 62, power is interrupted to the brakes 24*a* through 26*b*, thus causing them to activate and stop the car. The operator need only continuously hold the safety switch 62 closed to allow the car to descend slowly to the desired landing level, and release the safety switch when the desired landing level is reached in order to terminate electrical power to the brakes 24*a* through 26*b* to cause them to actuate.

It will be seen that this safety switch and brake operation is independent of the hydraulic rescue lowering or movement system provided by the restrictor orifice 40, which receives no electrical input at any time during rescue travel. The restrictor orifice 40 only comes into play when electrical power is terminated to the electro-hydraulic flow control valve 38, causing that valve 38 to close. Accordingly, the elevator safety rescue system provides a positive means of allowing the elevator cab to travel slowly and safely in the event of an electrical power interruption or other anomalous operation of the normal system.

The elevator safety rescue system of the exemplary tower elevator system illustrated in FIG. 2 is intended to travel downward to the surface from an elevated location, and thus depends upon the weight of the elevator car and its equipment to drive such downward travel in an emergency situation. However, it will be seen that the above-described electromechanical and hydraulic safety system is not limited only to tower or above-grade elevator installations. All of the electrical, electromechanical, and hydraulic components operate the same whether the elevator is traveling downward in a tower or upward from below ground level, except for the hydraulic flow path through the restrictor orifice 40. However, in the case of a below-ground installation in a mine or similar location, some means must be provided to raise the elevator car from a location below ground and back to the surface for rescue.

Figure 3:
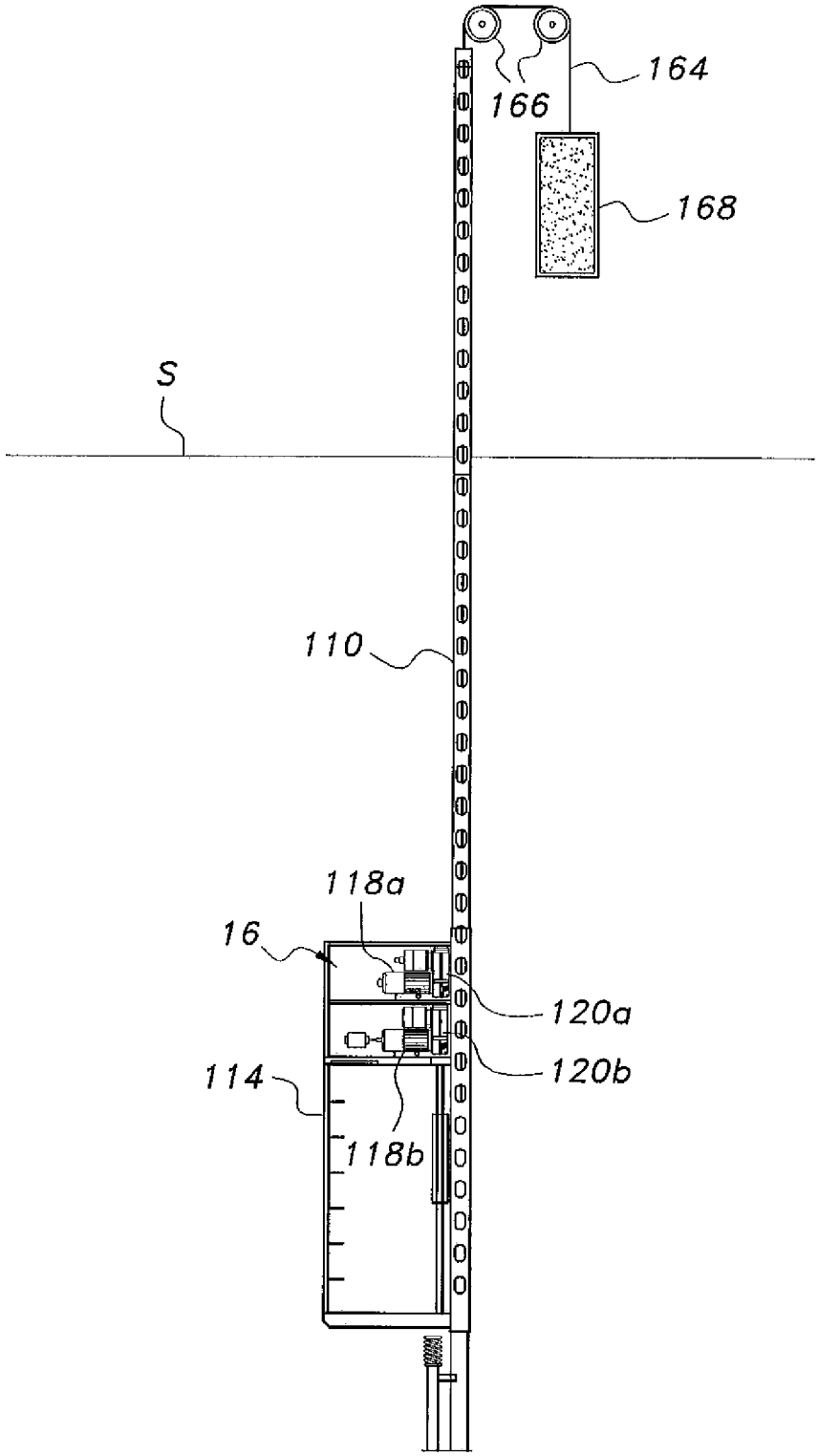
FIG. 3 is a side elevation view of a second exemplary elevator system incorporating an alternative embodiment of an elevator safety rescue system according to the present invention, showing a counterweight for lifting the elevator from the bottom of an elevator shaft and the elevator car at the bottom of the shaft.
Figure 4:
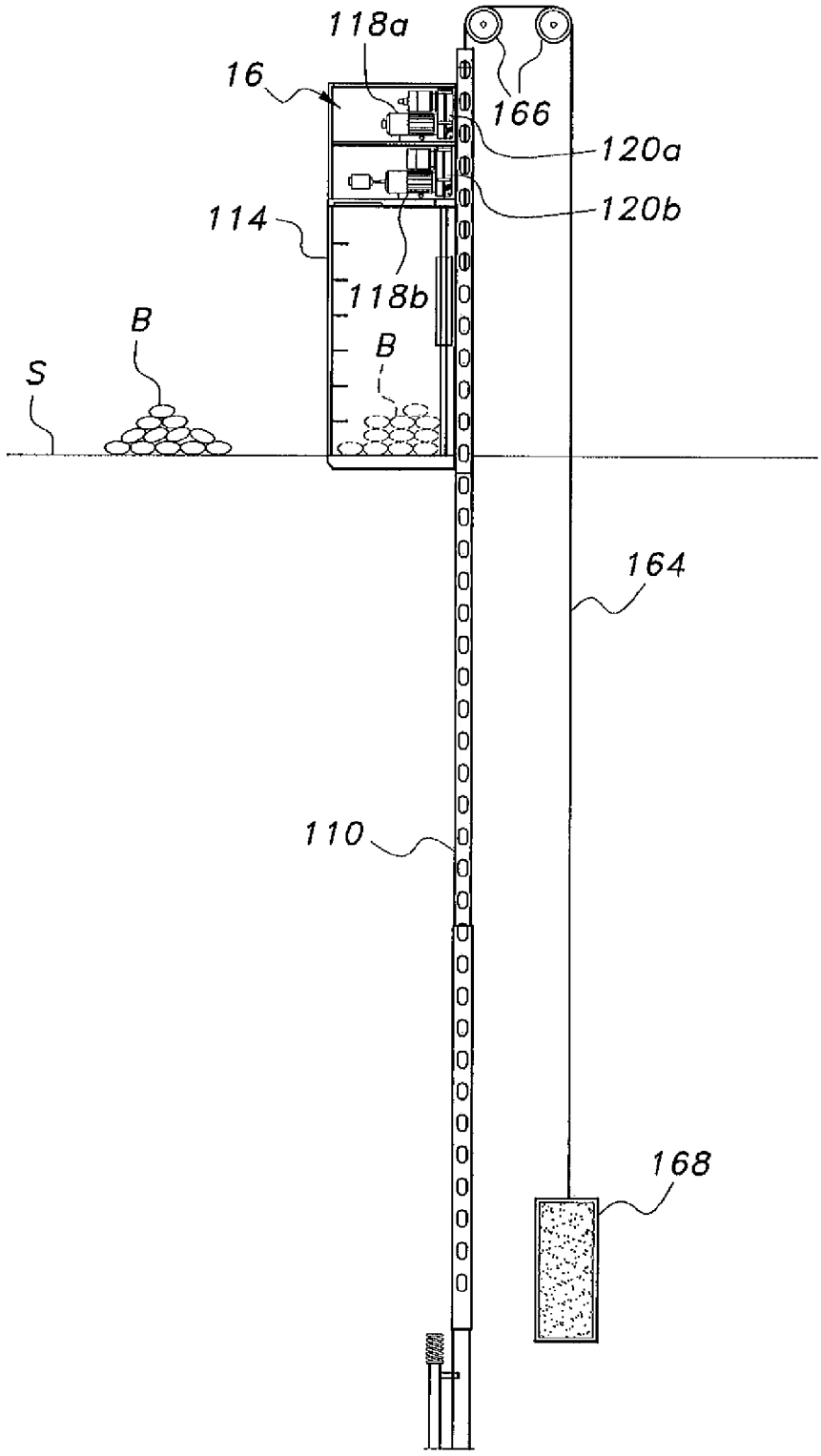
FIG. 4 is a side elevation view of the elevator safety rescue system of FIG. 3, showing the elevator ear lifted to the top of the shaft by the counterweight.

Accordingly, FIGS. 3 and 4 of the drawings illustrate an alternative embodiment wherein a counterweight is added to the system. The embodiment of FIGS. 3 and 4 illustrates an elevator installation below the surface S, as in a mine shaft or the like. The guiderail 110 is shown extending from some point above the surface S downward below the surface in FIGS. 3 and 4. The guiderail installation 110 includes a toothed elevator rack (not shown in FIGS. 3 and 4, but substantially the same as the toothed rack 12 illustrated in FIGS. 1 and 2) extending generally vertically therealong and an elevator car 114 engaging the rack and guiderail 110 for travel therealong.

The elevator car 114 is substantially the same as the elevator car 14 of FIGS. 1 and 2. The car 114 incorporates an identical safety system 16 to that illustrated in FIG. 1 and described in detail further above. First and second electrically powered drive motors 118*a* and 118*b* are installed atop the car 114, as in the case of the first embodiment. The first motor 118*a* is positioned directly above the second motor 118*b*. Each of these motors 118*a* and 118*b* is mechanically coupled to and drives a gearbox 120*a* and 120*b*, respectively. The gearboxes 120*a* and 120*b* provide the desired reduction of rotational speed and corresponding torque multiplication. Each gearbox 120*a*, 120*b* has an output shaft driving a pinion gear (not shown in FIGS. 3 and 4, but substantially identical to the pinion gears 22*a*, 22*b* illustrated in FIG. 1). The two pinion gears, in turn, engage the toothed elevator rack to raise and lower the elevator car 114 when power is applied to the two motors 118*a*, 118*b*.

The primary difference between the elevator car 14 of FIGS. 1 and 2 and the elevator car 114 of FIGS. 3 and 4 is the addition of a lift cable or cables 164 that extend from the elevator car 114 upward along the guiderails 110, over one or more guide sheaves or pulleys 166, and back downward to attach to a counterweight 168. The counterweight 168 has a greater weight than the combined weight of the elevator car 114, its lift cable(s) 164, and some predetermined payload to be carried within the elevator car 114. Thus, the elevator car 114 will always tend to rise when no power or brake effect is applied to the car 114. This is desired for a below-ground installation of the elevator and safety rescue system, as illustrated in FIGS. 3 and 4.

The safety system 16 of the elevator car 114 operates substantially identically to the safety system 16 described in detail for the elevator car 14 of the embodiment of FIGS. 1 and 2. To summarize, the safety system includes a positive displacement hydraulic pump that is directly connected to one of the two motors 118*a* or 118*b*. The hydraulic flow through the hydraulic pump is functionally unrestricted during normal elevator operation, but is highly restricted in the event of a rescue operation. This restricted hydraulic flow limits the rotational speed of the positive displacement hydraulic pump, in turn limiting the rotational speed of the drive motor and pinion gear to which the hydraulic pump is directly connected. This allows the elevator to travel at a safe speed by limiting the rotational speed of the drive system when the rescue function is actuated and the electric motor brake is released.

The hydraulic flow is controlled by an electro-hydraulic valve that automatically actuates to the flow restricted condition (fail-safe state) in the event of loss of electrical power to the system, including each time the elevator stops during normal operation. For car movement during normal operation, electrical power is provided to the electro-hydraulic flow valve, maintaining that valve in the open unrestricted flow condition. To effect a rescue operation, i.e., to lift the elevator car 114 from a point below the surface up to the surface S, simply requires that the included backup electrical power (UPS, or Uninterruptible Power Supply) be applied to release the electric motor drive brakes, thus allowing the counterweight 168 to lift the elevator car 114 upward by means of the lift cable(s) 164. Control of the elevator movement is accomplished by the restricted hydraulic oil flow through the hydraulic restrictor valve that is automatically set to the flow-restricted position absent electrical power to the restrictor valve.

The only difference between the safety system 16 as applied to the elevator car 14 of FIGS. 1 and 2 and as applied to the elevator car 114 of FIGS. 3 and 4 is that the ascending elevator car 114 will rotate its drive motors 118*a*, 118*b* in the opposite direction from the rotation of the motors 18*a*, 18*b* in the descending car 14 of the scenario that was described further above for a descending elevator car 14 in a tower embodiment, as shown generally in FIG. 2. This results in the hydraulic fluid flow developed by the positive displacement pump 32 (shown FIG. 1) flowing in the opposite direction through the restrictor valve or orifice 40 (FIG. 1) when the elevator car 114 is being lifted, as in FIGS. 3 and 4, as opposed to the descending car 14 of FIGS. 1 and 2. However, the physical components of the system 16 are identical for the tower elevator installation of FIG. 2 and the below-surface installation of FIGS. 3 and 4.

It will be seen that the heavier counterweight 168 will lift the elevator car 114 to the surface, but absent any electrical power to the two drive motors 118*a*, 118*b*, the unladen elevator car 114 cannot negotiate a powered descent to continue the rescue operation. Accordingly, the car 114 may be weighted with ballast B (e.g., sand bags, water jugs or barrels, etc,) to increase the weight of the loaded elevator car 114 so that it exceeds the weight of the counterweight 168 and lift cable(s) 164.

In FIG. 3 of the below-surface rescue operation, the elevator car 114 does not have any on-board ballast (any personnel and/or equipment on board are not shown in FIG. 3, but the total weight of the car 114, its load, and the cable(s) 164 must be less than the counterweight 168), and will rise as described above, lifting any personnel and/or equipment up to the surface as the heavier counterweight 168 descends. The restricted hydraulic flow through the orifice 40 (FIG. 1) prevents the elevator car 114 from rising too rapidly, particularly as the lift cable(s) 164 pass over the pulleys or sheaves 166 to add their weight to the counterweight 168.

When the elevator car 114 reaches the surface S, as shown in FIG. 4, power to the various brakes (see FIG. 1) is terminated, locking the brakes to prevent movement of the car. In any event, the heavier weight of the counterweight 168 and cable(s) 164 will hold the elevator car 114 at the surface unless additional weight is installed in the car 114. Accordingly, FIG. 4 shows ballast B (in broken lines, within the car 114) being added from a ballast B supply (solid lines) immediately adjacent to the car 114 at the surface S. When sufficient ballast B has been added to the car 114 (along with any rescue or other personnel and/or equipment required for the descent), the brakes may be released by providing power from the uninterruptible power supply 60 (see FIG. 1) to allow the car 114 to descend, as its total weight exceeds that of the counterweight 168 and cable(s) 164. It will be seen that as the cable(s) length is reduced on the counterweight side and lengthened on the elevator car side as the ear 114 descends, there will be an accelerating downward force on the elevator car 114. However, the hydraulic fluid restriction orifice 40 of the system prevents excessive downward velocity, permitting the car to descend slowly and safely until reaching the bottom of the shaft. It will be seen that the on-board operator of the elevator car 114 may merely remove electrical power from the brakes at any time he or she wishes to stop the car 114 at some intermediate height in the shaft, if desired.

At this point, the electrical power is removed from the brakes, thereby locking the brakes to prevent movement of the elevator car 114. Any personnel and/or equipment to be conveyed to the surface S may be loaded at this time (subject to maximum weight limits to avoid exceeding the weight of the counterweight and cable(s)), and the ballast B is removed. Electrical power is once again applied to the brakes to release them, and the elevator car 114 begins another trip to the surface S. This process of lowering the car by means of ballast and lifting personnel and/or equipment from below the surface may be continued as long as necessary to complete the operation. The ballast at the bottom of the shaft may be returned to the surface once normal elevator operations are resumed.

It is to be understood that the present invention is not limited to the embodiments described above, but encompasses any and all embodiments within the scope of the following claims.

We claim:

1. An elevator safety rescue system, comprising:

at least one elevator guiderail;

an elevator car disposed on the guiderail;

a counterweight, a pulley system mounted above the guiderail, and a cable extending over the pulley system and connecting the counterweight to the elevator car, the counterweight having a greater weight than the elevator car and the cable so that the counterweight biases the elevator car to rise on the guiderail;

at least one electrically powered drive motor disposed with the elevator car, the drive motor being coupled to an elevator transit mechanism, the drive motor having an output shaft;

a positive displacement hydraulic pump rotationally coupled to the output shaft of the drive motor;

a hydraulic circuit communicating with the hydraulic pump;

an electro-hydraulic flow control valve disposed in the hydraulic circuit in series with the hydraulic pump;

a restrictor orifice disposed in the hydraulic circuit in parallel with the electro-hydraulic flow control valve; and a normally operational electric circuit providing electric power to the electro-hydraulic flow control valve during normal elevator operation;

wherein the electro-hydraulic flow control valve is maintained in an open condition when electrical power is provided thereto by the normally operational electric circuit, the electro-hydraulic flow control valve closing when electrical power thereto is terminated, thereby routing all hydraulic fluid through the restrictor orifice and restricting hydraulic flow through the hydraulic pump with corresponding reduction in rotational speed thereof and of the drive motor coupled thereto.

2. The elevator safety rescue system according to claim 1, further comprising:

a gearbox rotationally coupled to the at least one drive motor;

a pinion gear rotationally coupled to the gearbox; and an elevator rack disposed externally to the elevator car and along the guiderail, the rack being engaged by the pinion gear.

3. The elevator safety rescue system according to claim 1, wherein said at least one drive motor comprises a first drive motor and a second drive motor, the first drive motor being disposed above the second drive motor.

4. The elevator safety rescue system according to claim 3, wherein said first and second drive motors have first and second gearboxes mechanically coupled thereto.

5. The elevator safety rescue system according to claim 4, further comprising:

a first electromechanical motor brake disposed with the first drive motor;

a second electromechanical motor brake disposed with the second drive motor;

a first electromechanical rack and pinion brake disposed with the first gearbox; and a second electromechanical rack and pinion brake disposed with the second gearbox.

6. The elevator safety rescue system according to claim 1, further comprising:

a plurality of electrically released brakes, each of the brakes communicating with the normally operational electrical circuit; and an emergency brake system terminating electrical power to each of the brakes for brake actuation.

7. The elevator safety rescue system according to claim 6, further comprising an electrical storage battery selectively communicating with each of the brakes for selective release thereof when electrical power from the normally operational electrical circuit is terminated.

8. The elevator safety rescue system according to claim 6, further comprising;

an electrical generator rotationally coupled to the drive motor;

an overvoltage detector electrically coupled to the generator;

an electrical cutoff switch electrically coupled to the overvoltage detector, the electrical cutoff switch selectively terminating electrical power to each of the brakes upon receiving a signal from the overvoltage detector.

9. The elevator safety rescue system according to claim 1, further comprising:

a speed and position control device rotationally coupled to the drive motor; and a control system electronically coupled to and monitoring the speed and position control device, the control system communicating with the normally operational electric circuit and terminating power therefrom when anomalous output is received from the speed and position control device.

10. The elevator safety rescue system according to claim 1, further comprising an overpressure relief bypass valve disposed in the hydraulic circuit.

11. A rack and pinion elevator and elevator safety rescue system therewith, comprising in combination:

at least one elevator guiderail;

an elevator car disposed on the guiderail;

a counterweight, a pulley system mounted above the guiderail, and a cable extending over the pulley system and connecting the counterweight to the elevator car, the counterweight having a greater weight than the elevator car and the cable so that the counterweight biases the elevator car to rise on the guiderail;

at least one drive motor disposed with the elevator car;

a gearbox rotationally coupled to the drive motor;

a pinion gear rotationally coupled to the gearbox;

an elevator rack disposed externally to the elevator car and along the guiderail, the rack being engaged by the pinion gear;

an output shaft extending from the drive motor opposite the gearbox;

a positive displacement hydraulic pump rotationally coupled to the output shaft of the drive motor;

a hydraulic circuit communicating with the hydraulic pump;

an electro-hydraulic flow control valve disposed in the hydraulic circuit in series with the hydraulic pump;

a restrictor valve disposed in the hydraulic circuit in parallel with the electro-hydraulic flow control valve; and a normally operational electric circuit providing electric power to the electro-hydraulic flow control valve during normal elevator operation;

wherein the electro-hydraulic flow control valve is maintained in an open condition when electrical power is provided thereto by the electric circuit, the electro-hydraulic flow control valve closing when electrical power is terminated thereto, thereby routing all hydraulic fluid through the restrictor valve and restricting hydraulic flow through the hydraulic pump, with corresponding reduction in rotational speed thereof and of the drive motor, gearbox, and pinion gear coupled thereto, thereby providing a safe descent speed for the elevator car on the guiderail.

12. The rack and pinion elevator and elevator safety rescue system combination according to claim 11, wherein said at least one drive motor comprises a first drive motor and a second drive motor, the first drive motor being disposed above the second drive motor.

13. The rack and pinion elevator and elevator safety rescue system combination according to claim 12, wherein said first and second drive motors have first and second gearboxes mechanically coupled thereto.

14. The rack and pinion elevator and elevator safety rescue system combination according to claim 13, further comprising:

a first electromechanical motor brake disposed with the first drive motor;

a second electromechanical motor brake disposed with the second drive motor;

a first electromechanical rack and pinion brake disposed with the first gearbox; and a second electromechanical rack and pinion brake disposed with the second gearbox.

15. The rack and pinion elevator and elevator safety rescue system combination according to claim 11, further comprising:

a plurality of electrically released brakes, each of the brakes communicating with the normally operational electrical circuit; and an emergency brake system terminating electrical power to each of the brakes for brake actuation.

16. The rack and pinion elevator and elevator safety rescue system combination according to claim 15, further comprising an electrical storage battery selectively communicating with each of the brakes for selective release thereof when electrical power from the normally operational electrical circuit is terminated.

17. The rack and pinion elevator and elevator safety rescue system combination according to claim 15, further comprising:

an electrical generator rotationally coupled to the drive motor;

an overvoltage detector electrically coupled to the generator;

an electrical cutoff switch electrically coupled to the overvoltage detector, the electrical cutoff switch selectively terminating electrical power to each of the brakes upon receiving a signal from the overvoltage detector.

18. The rack and pinion elevator and elevator safety rescue system combination according to claim 11, further comprising:

a speed and position control device rotationally coupled to the drive motor; and a control system electronically coupled to and monitoring the speed and position control device, the control system further communicating with the normally operational electric circuit and terminating power therefrom when anomalous output is received from the speed and position control device.

19. The rack and pinion elevator and elevator safety rescue system combination according to claim 11, further comprising an overpressure relief bypass valve disposed in the hydraulic circuit.

* * * * *